United States Patent [19]

Iwabuchi et al.

[11] Patent Number: 4,922,885

[45] Date of Patent: May 8, 1990

[54] PITCHING MACHINE

[75] Inventors: Shigeru Iwabuchi, Aikawa; Aritsune Sato, Atsugi; Haruo Ueno, Zama, all of Japan

[73] Assignee: Nagao Company, Inc., Tokyo, Japan

[21] Appl. No.: 224,848

[22] Filed: Jul. 27, 1988

[30] Foreign Application Priority Data

Sep. 22, 1987 [JP] Japan ..... 62-144844[U]

[51] Int. Cl.[5] ..... F41B 15/00

[52] U.S. Cl. ..... 124/78; 124/82

[58] Field of Search ..... 124/6, 41 C, 41 R, 82, 124/78; 221/267, 268, 270, 271, 272, 275, 276

[56] References Cited

U.S. PATENT DOCUMENTS

| | | | |
|---|---|---|---|
| 1,204,468 | 11/1916 | Marty | 124/6 |
| 1,584,395 | 5/1926 | Nichols | 221/275 X |
| 2,525,765 | 10/1950 | Betge | 221/267 X |
| 2,716,973 | 9/1955 | Desi | 124/78 |
| 3,538,900 | 11/1970 | Samuels | 124/78 |
| 3,794,011 | 2/1974 | Newgarden | 124/78 |
| 4,197,827 | 4/1980 | Smith | 124/78 |
| 4,423,717 | 1/1984 | Kahelin | 124/78 |

*Primary Examiner*—Randolph A. Reese
*Assistant Examiner*—John A. Ricci
*Attorney, Agent, or Firm*—Spencer & Frank

[57] ABSTRACT

A machine for pitching baseballs includes two discs which are mounted on independently rotatable shafts. The discs have urethane at their peripheries. The spacing between the shafts can be adjusted in order to set the width of a gap between the discs. A ball feed mechanism inserts balls into the gap between the discs, which then fling the balls outward in a pitching style which depends upon the orientation of the pitching machine and the relative rotational speeds of the discs. In one embodiment, the ball feed mechanism employs a tubular feed body having a tapered outlet end which is positioned adjacent the gap. A piston in the feed body reciprocates to push the balls out. In another embodiment, the ball feed mechanism is mounted on a chassis having casters and is connected via a flexible hose to a feed nozzle positioned adjacent the gap. A reciprocating slider transfers balls from a storage chamber to an inverted-T tube arrangement, whence they are blown pneumatically through the hose to the feed nozzle.

20 Claims, 6 Drawing Sheets

PITCHING MACHINE

BACKGROUND OF THE INVENTION

The present invention relates to a pitching machine, and more particularly to such a machine which has a variety of pitching styles such as fastballs, curve balls, sliders, etc.

A prior art pitching machine, as shown in Japanese Design Patent No. 363,180, has two rotating discs. Balls are supplied in between these discs and thrown out therefrom.

According to the prior art, the outer circumferential parts of the rotating discs are made of urethane, whose frictional force is used to throw the balls. In use, however, the urethane is worn off and the distance between the discs changes. If such change is left as it is, the pitching becomes unsteady and balls may be thrown in unexpected directions. Because of this a problem arises in that the distance between the discs must be adjusted if the outer circumference of the urethane becomes worn.

A further problem in the prior art is that the desired pitching is unavailable unless balls are correctly supplied between the rotating discs.

SUMMARY OF THE INVENTION

An object of the present invention is to provide a pitching machine which facilitates adjustment of the distance between ball-throwing rotary discs.

Another object of the present invention is to provide a pitching machine which can steadily feed balls in between ball-throwing rotary discs even if the machine body is tilted during operation, thereby assuring the desired pitching style.

Still another object of the present invention is to provide a ball feed mechanism which can keep many balls in a storage chamber and pitch the balls consecutively, and if connected via a flexible hose to a pitching mechanism, the ball feed mechanism can be set anywhere within the reach of the hose.

According to the present invention, there is provided a pitching machine comprising: two parallel rotary shafts projecting from a machine housing; rotary discs mounted on said rotary shafts with the outer circumferences being made of urethane; an adjustment mechanism inside the housing for adjusting the distance between the rotary shafts; a drive mechanism capable of the selecting rotational direction and rotational frequency of said rotary shafts; and a ball feed mechanism interposed between said rotary discs, said ball feed mechanism comprising a cylindrical feed body whose outlet is interposed between the rotary discs, a piston provided in said feed body and reciprocating relative to said outlet, and a ball supply tube provided in the side of the feed body and communicating therewith, so that the desired ball pitching is assured.

According to another aspect of the present invention, there is provided a ball feed mechanism comprising a ball supply tube having an opening in the top, a ball feed tube having an opening in the top, a ball feed tube having both ends open and provided at the lower end of said supply tube in a perpendicular relation with the axis of said ball supply tube, said ball feed tube being connected at one end to a blow port of an electric blower mounted on a body and at the other end to a flexible hose reaching at a pitching mechanism, a slider having a hole of the same diameter as the opening of said ball supply tube and being capable of horizontal reciprocation, and a storage chamber located above said slider and mounted to the body, for keeping many balls and supplying balls one by one toward said slider.

DESCRIPTION OF THE PREFERRED EMBODIMENTS

Figure 1:
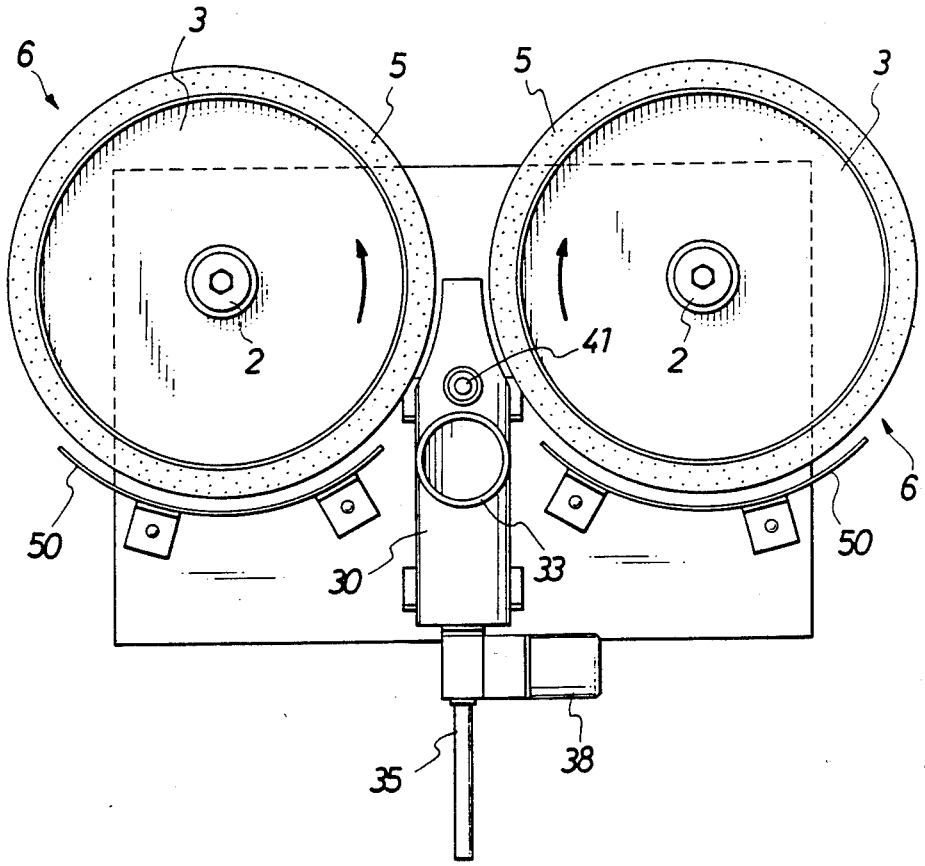
FIG. 1 is a top plan view of a pitching machine in accordance with an embodiment of the present invention.
Figure 2:
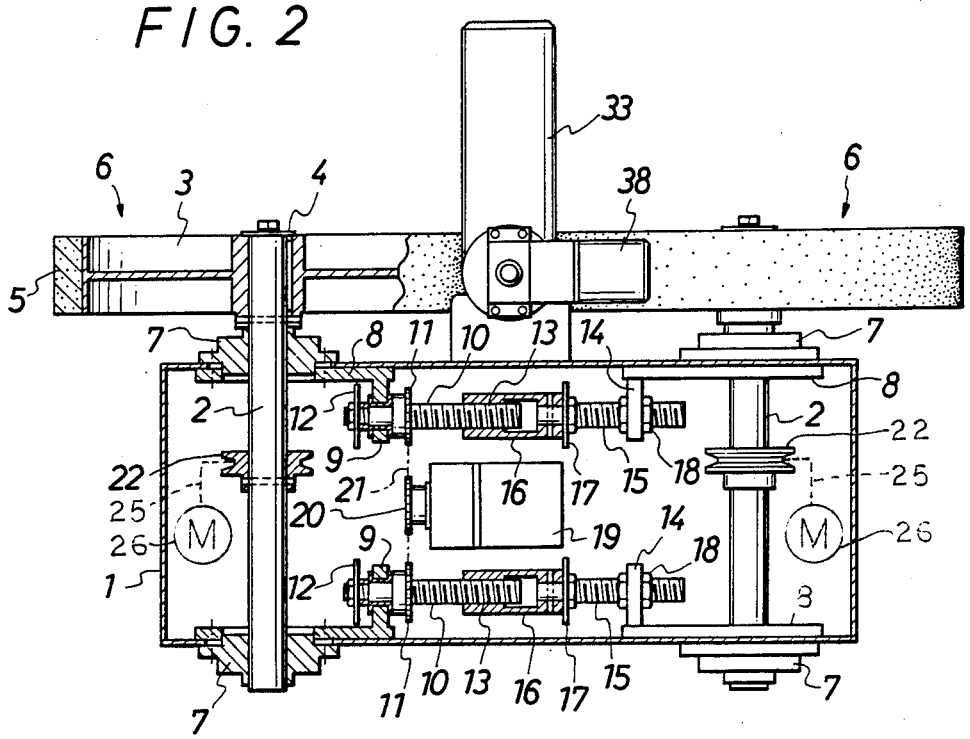
FIG. 2 is a vertical sectional view of the pitching machine of FIG. 1.

With initial reference to FIGS. 1 and 2, a pitching machine in accordance with an embodiment of the present invention includes a box-shaped housing 1, from which two rotary shafts 2 project. Discs 3 are coplanar and are fixed, via keys 4, on the projecting portions of the rotary shafts 2. Discs 3 are fitted with urethane members 5 on the outer circumferences thereof so as to form urethane wheels 6.

Each of the rotary shafts 2 is mounted by bearing blocks 7 which are disposed outside of the housing 1, and the bearing blocks 7 are integral with bearing mounting plates 8 which are disposed inside the housing 1. At least on one side of the housing 1, the bearing mounting plates 8, together with the bearing blocks 7, are mounted to be moveable in a direction perpendicular to the longitudinal direction of the rotary shaft 2.

Lips 9 are formed on the bearing mounting plates 8 (those on the left side in FIG. 2) and shaft members 10 are rotatably mounted via bearings. Shaft members 10 extend in the direction perpendicular to the (left-side) rotary shaft 2, that is, in the direction of movement of the bearing mounting plates 8. Sprocket wheels 11 and photo-sensor discs 12 are provided on the shaft members 10 and located on opposite sides of the lips 9. Although not illustrated, each disc 12 has a plurality of openings and is disposed between a light source and a light detector so that the rotational angle of the respective shaft member 10 can be detected. The shaft members 10 are formed as screw rods 13 at least at the ends thereof.

The other bearing mounting plates 8 (on the right side in FIG. 2) are formed with lips 14, in which auxiliary adjustment screw rods 15 are engaged perpendicularly to the (right-side) rotary shaft 2. The auxiliary adjustment screw rods 15 are provided with nuts 16 which, in turn, are engaged with the screw rod portions 13 of the shaft members 10. Numerals 17 indicate limit switch discs provided on the auxiliary adjustment screw rods 15 and numerals 18 indicate nuts for fixing the auxiliary adjustment screw rods 15 to the lips 14.

A motor 19 has a sprocket wheel 20 on its drive shaft, and a chain 21 is mounted around the sprocket wheel 20 and the sprocket wheels 11 of the shaft members 10 so that, when the sprocket 20 wheel is rotated by the motor 19, the shaft members 10 are rotated and moved axially. This axial movement displaces the rotary shaft 2 together with the lips 9 and the bearing mounting plates 8, thereby adjusting the distance between the urethane wheels 6. While motor 10 is shown between shaft members 10 in FIG. 2, it is mounted at a position spaced apart from a plane running through shaft members 10 and hence the sprocket wheel 21 is separated from the sprocket wheels 11 by a distance which is sufficient to permit chain 21 to remain in engagement with the sprocket wheels despite the axial displacement of the shaft members 10.

Pulleys 22 are mounted on the rotary shafts 2 and are linked by belts 25 with driving motors 26 so as to rotate the urethane wheels 6, the belts 25 and motors 26 being shown only schematically. Because the left and right rotary shafts 2 may need to be rotated at different rotational speeds, they are driven by two separate motors.

Since the left and right urethane wheels 6 are driven independently, it is possible to rotate them at the same or different rotational speeds or angular velocities. The urethane wheels 6 are arranged to be apart from each other by a distance a little smaller than the ball diameter, and the left one is adapted to rotate counterclockwise while the right one rotates clockwise.

When a ball is supplied in between the urethane wheels 6, the ball will be sprung out by a strong force therefrom. By selecting the orientation and angle of inclination of the housing 1 and the rotational speed of the urethane wheels 6, the desired pitching style is available.

Figure 3:
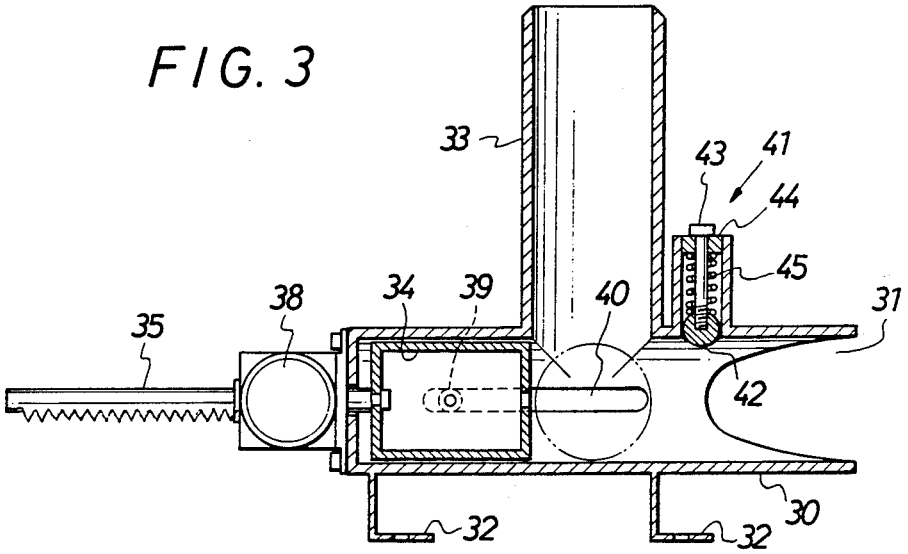
FIG. 3 is a vertical sectional view of a ball feed mechanism used in the embodiment of FIG. 1.
Figure 4:
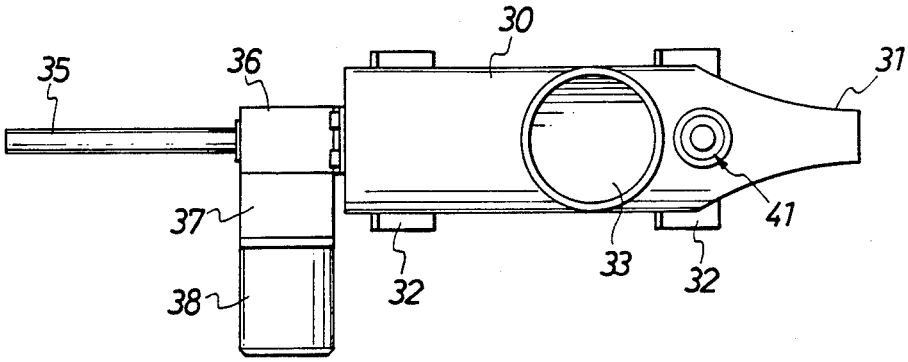
FIG. 4 is a top plan view of the ball feed mechanism.
Figure 5A:
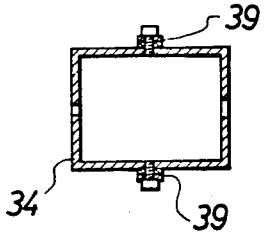
FIGS. 5 show a piston which is a part of the ball feed mechanism, with FIG. 5A being a top plan view and FIG. 5B being a front view thereof.
Figure 5B:
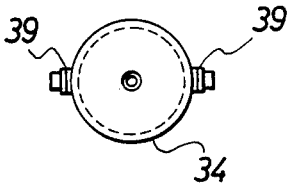

Next, a ball feed mechanism will be described with reference to FIGS. 3 to 5.

A feed body 30 for the ball feed mechanism is cylindrical and open at one end, where an outlet 31 is formed with the sides being cut in a taper. The outlet 31 is located midway between the urethane wheels 6. The feed body 30 has mounting legs 32 on its lower side and is secured thereby to the housing 1. A ball supply tube 33 vertically protrudes from the feed body 30 and has an opening in the top from which balls are supplied. A piston 34 is housed in the feed body 30 so as to retract behind the rear of the supply tube 33 and advance toward the outlet 31. A toothed rack 35 forms a piston rod for the piston 34. Numeral 36 indicates a linear head having a drive pinion (not shown) which meshes with rack 35. Numeral 38 indicates a motor, and numeral 37 indicates a gear head which receives power from motor 38 and rotates the drive pinion in linear head 36 at a relatively slow speed. The drive from the motor 38 causes the rack 35 to move back and forth, thereby reciprocating the piston 34.

To stabilize the engagement of the rack gear 35 with its associated drive pinion, the piston 34 is provided with bearings 39 on opposite sides thereof. Bearings 39 are received in guide slots 40 formed longitudinally along the side of the feed body 30.

A ball stopper 41 is provided between the supply tube 33 and the outlet 31. The stopper 41 has a ball member 42 which protrudes inwardly of the feed body 30 and is mounted to be movable up and down by a mounting screw 43. A spring 45 is disposed between a collar 44 for the mounting screw 43 and the ball member 42. The ball member 42 protrudes into the feed body 30 except when a ball is being forced out by piston 34.

With the piston 34 being retracted within the feed body 30, a ball is inserted through the supply tube 33 into the feed body 30. Then the motor 38 is driven to advance the piston 34 toward the outlet 31, whereupon the ball proceeds against the stopper 41 and is fed from the outlet 31 in between the urethane wheels 6 and, as was mentioned previously, the ball is thrown out from between the rotating wheels 6.

Further, protection covers 50 (see FIG. 1) are provided on the top of the housing 1 so as to cover a portion of the circumference of the urethane wheels 6.

Figure 6:
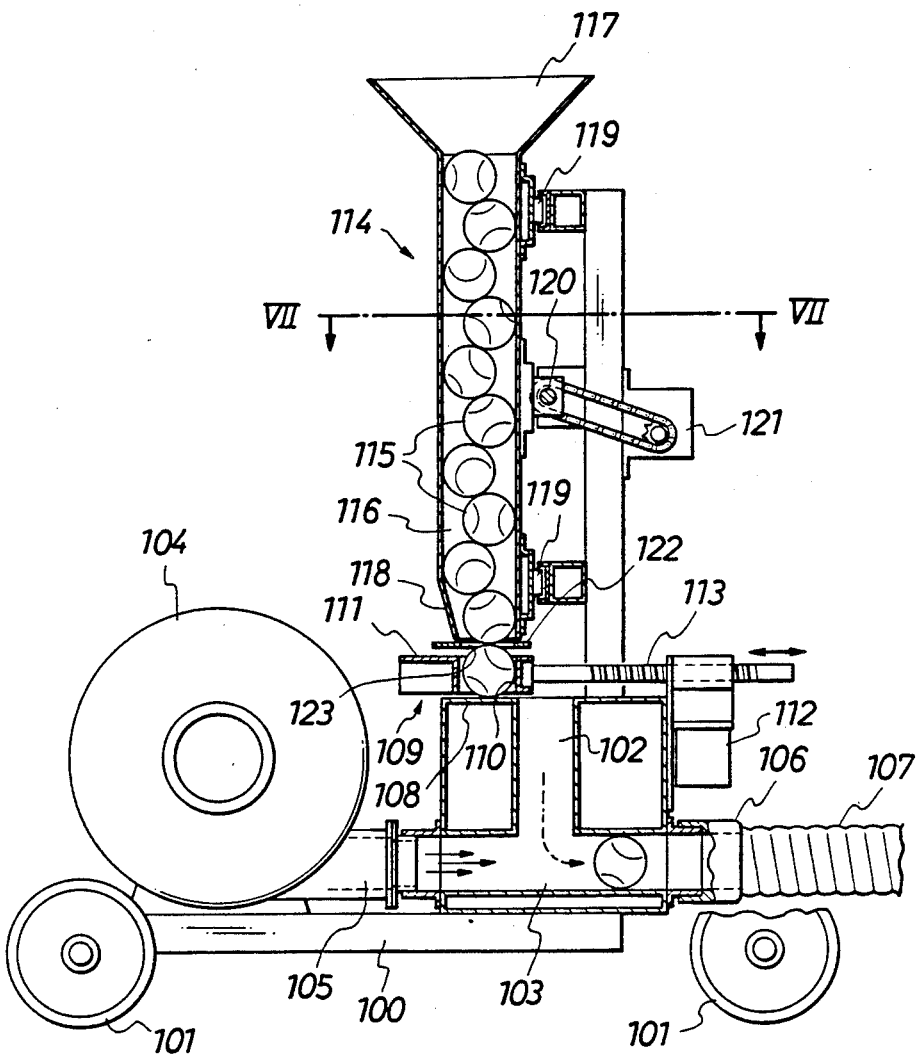
FIG. 6 is a vertical sectional view of ball feed mechanism in accordance with another embodiment of the invention.
Figure 7:
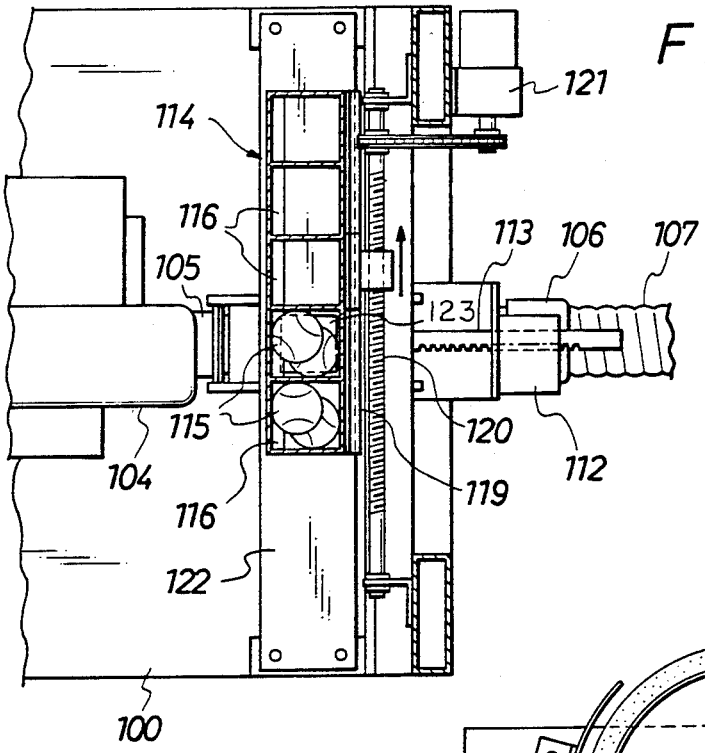
FIG. 7 is a sectional view taken along line VII—VII of FIG. 6.
Figure 8:
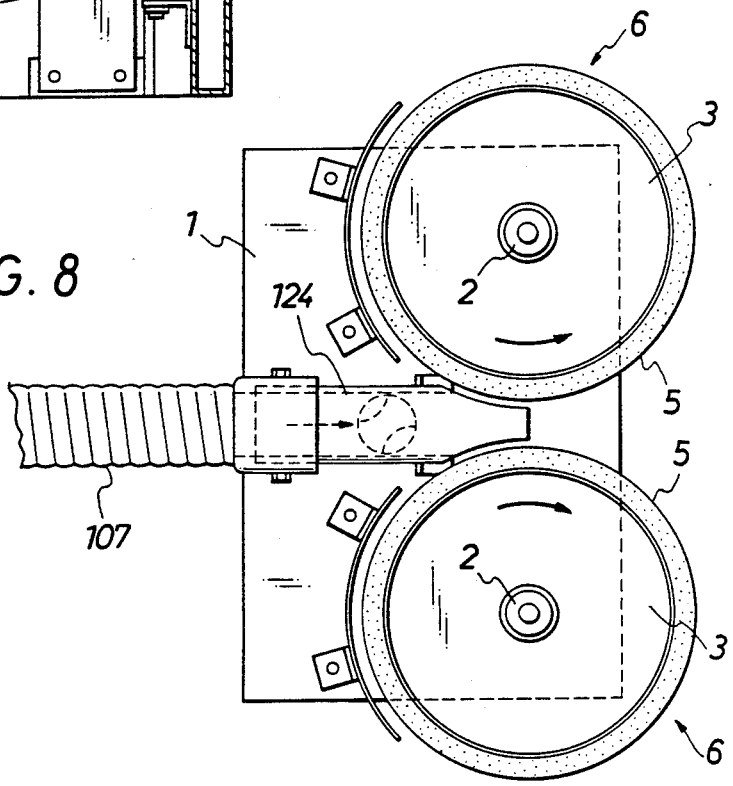
FIG. 8 is a top plan view of a ball-feeding flexible hose shown in FIG. 6 and the pitching machine connected therewith.

Another ball feed mechanism will now be described with reference to FIGS. 6–8.

A chassis 100 for this ball feed mechanism is movable on casters 101. The chassis 100 is provided with a top-open supply tube 102 and, thereunder, a feed tube 103 extending perpendicular to an axis of the supply tube 102. The feed tube 103 is open on both ends, and one end is connected to a blow port 105 of an electric blower 104 while the other is connected through a hose joint 106 to a flexible hose 106 which extends to the pitching machine.

The upper opening of the supply tube 102 is formed with a rack plate 108, on which a slider 109 is adapted to move horizontally. The slider 109 has an opening 110 of the same diameter as the opening in the supply tube 102, and a plate 111 for closing an outlet of a ball storage chamber 114 to be described later. The slider 109 is fixed to a toothed rack 113 which is driven by a reciprocating mechanism 112 which, although not illustrated, includes a motor, speed-reduction gearing, and a drive pinion which meshes with rack 113.

The storage chamber 114 is mounted on the chassis 100 so that it is superposed on the slider 109 and mounted so that it is movable in the direction perpendicular to the slider movement. The storage chamber 114 is divided into a plurality of compartments 116, each having space for housing approximately ten balls 115. The upper end of the storage chamber 114 is formed as a funnel-shaped guide inlet 117 and the lower end is formed as a tapering outlet 118. Lower and upper slide mechanisms 119 are provided behind the storage chamber 114 so as to allow it to slide back and forth in the horizontal direction. A screw rod 120, which is mounted between the slide mechanisms 119 and rotated by a driving motor 121, permits the storage chamber 114 to move back and forth in the axial direction of the screw rod 120.

Every compartment 116 of the storage chamber 114 is open at the lower end, but a partition 122 provided on the chassis 100 closes the opening to prevent balls from falling down. The partition 122 has an opening 123 at a position corresponding to the slider 109, and when the opening 123 is aligned with one of the compartments 116, a ball in such compartment is supplied into the supply tube 102.

In order to feed a ball 115 to the urethane wheels 6 on the housing 1, a feed nozzle 124 having a tip end with both sides tapered is located in between the urethane wheels 6, and the feed nozzle 124 is connected to the flexible hose 107 which is connected to the feed tube 103.

In the above-constructed ball supply mechanism of the present pitching machine, the urethane wheels 6 rotate in opposite directions to each other and the electric blower 104 is actuated to supply pressurized air to the feed tube 103, the flexible hose 104, and the feed nozzle 124. When a ball 115 is supplied to the supply tube 102, the ball is sent to the feed tube 103 and at the same time carried by the pressurized air from the blower 104 through the flexible hose 107 into the feed nozzle 124. Feed nozzle 124 inserts the ball between the urethane wheels 6, which then pitch the ball at the desired speed and in the desired manner.

While the pitching machine is in operation, the slider 109 has a "waiting" position such that the opening 110 is located over rack plate 108 of the supply tube 102, permitting a ball 115 from the storage chamber 114 to be kept in the opening 110. When a person gets ready to bat, the reciprocating mechanism 112 is actuated to move the slider 109 via the rack 113. Once the opening 110 comes into alignment with the supply tube 102, the ball 115 falls down into the supply tube 102 and then reaches the feed tube 103, where the ball is carried away to the feed nozzle 124 by the pressurized air from the blower 104.

When the slider 109 is displaced to drop a ball 115 into the supply tube 102, the slider plate 111 closes the opening 123 in the partition 122 and therefore prevents the balls 115 in the storage chamber 114 from falling down. After delivering a ball 115 to the supply tube 102, the slider 109 returns to the "waiting" position and another ball is received into the opening 110. The slider 109 stops at the "waiting" position, thereby completing one cycle of operation.

When all balls 115 in one compartment 116 are consumed, the screw rod 120 is rotated by the driving motor 121 until the next compartment 116 comes in alignment with the opening 123 of the partition 122. The ball feed mechanism may be resupplied by loading balls when one compartment 116 or all compartments 116 are empty of balls.

Examples of Experiment

Figure 9:
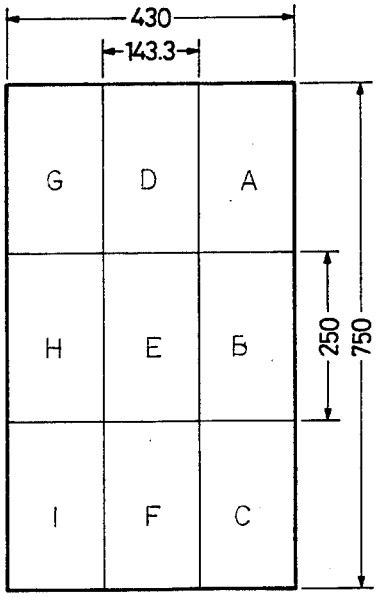
FIG. 9 is a front view of a target used in experiments.

As shown in FIG. 9, a 430 mm-wide by 750 mm-long board was divided into nine equal parts. The center portion, indicated by reference character E (144.3 mm wide and 250 mm long), was used as the strike zone. The present pitching machine was placed 18.44 m from this board.

Figure 10A:
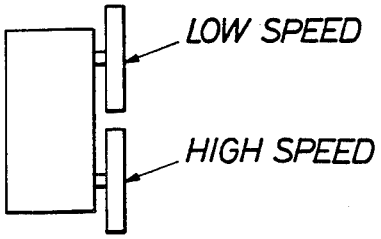
FIG. 10A to 10H are schematic representations showing how the pitching machine is used.

As shown in FIG. 10A, the housing 1 was oriented so that the urethane wheels 6 were vertically disposed, and the upper wheel was rotated at 1200 rpm while the lower one was rotated at 2340 rpm. Balls were fed in between these wheels 6 and pitched as straight fastballs toward the target. Hardtype balls 74 mm in diameter were used.

The test results of pitching balls toward the strike zone (reference character E) under the above-described condition were as follows.

With the wheels 54 mm apart:

48 balls were pitched and 26 of them hit the strike zone E. The hitting rate or accuracy was 54% and the average ball speed was 112.3 km/H.

With the wheels 52 mm apart:

48 balls were pitched and 46 of them hit the strike zone E. The hitting rate was 96% and the average ball speed was 34.0 km/H.

With the wheels 50 mm apart:

48 balls were pitched and all of them hit the strike zone E. The hitting rate 100% and the average ball speed was 38.7 km/H.

The above test results proved that it is easy to control balls and provide a high hitting rate if the urethane wheels 6 are separated by a gap of 50 mm to 52 mm. Further, it was found that the faster the wheels are rotated, the higher the ball speed becomes, and vice versa. A variety of pitching styles are available by selecting the rotational speed of the left and right wheels and by changing the angle of inclination of the housing.

FIGS. 10A through 10H show applications of the pitching machine, all of them for a right-handed batter. Every drawing is seen from the ball feed side.

FIG. 10A is for a straight fastball.

Figure 10B:
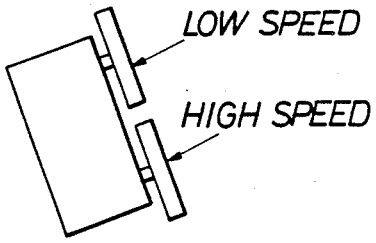

FIG. 10B is for a ball that veers upward from right to left (a slider of an underhand pitcher).

Figure 10C:
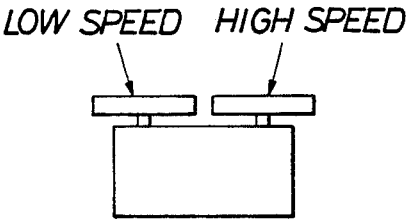

FIG. 10C is for a slider that veers right to left.

Figure 10D:
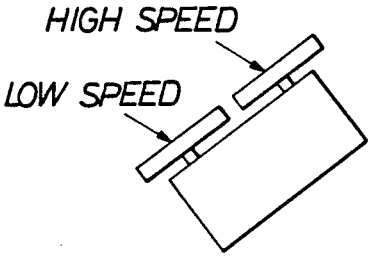

FIG. 10D is for a curve ball.

Figure 10E:
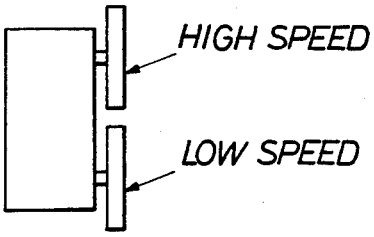

FIG. 10E is for a curve ball that drops vertically (a drop ball).

Figure 10F:
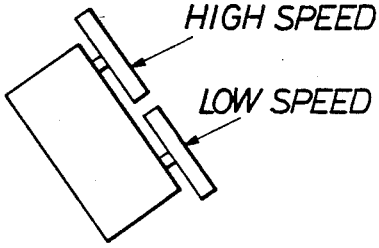

FIG. 10F is for a shoot ball.

Figure 10G:
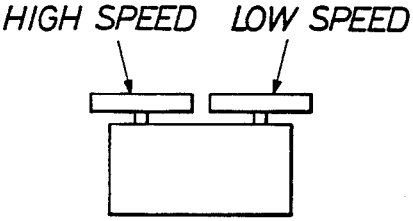

FIG. 10G is for a ball that veers from left to right (a slider).

Figure 10H:
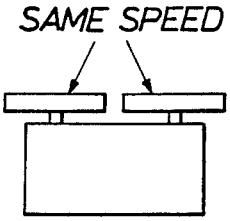

FIG. 10H is for a knuckle ball or fork ball.

Because the urethane wheels 6 throw the balls while pressing them tightly, the center portions of the wheels will be worn off according to the ball shape. When this occurs, the sides of the urethane wheels 6 should be ground to flatten them.

Furthermore the distance between the urethane wheels 6 should be adjusted by driving the motor 19 to move the shaft members 10 axially and draw together the rotary shafts 2 and the bearing blocks 7.

The present disclosure relates to the subject matter disclosed in Japanese application 62-144,844 of Sept. 22nd, 1987, Japanese application 62-19502 of Jan. 28th, 1987, and Japanese Utility Model application 62-17558 of Feb. 9th, 1987, the entire disclosures of which are incorporated herein by reference.

It will be understood that the above description of the present invention is susceptible to various modifications, changes, and adaptations, and the same are intended to be comprehended within the meaning and range of equivalents of the appended claims.

What is claimed is:

1. A pitching machine, comprising:

a housing;

two parallel rotary shafts projecting from said housing;

two rotary discs respectively mounted on said shafts, said discs having outer circumferences made of urethane;

adjustment mechanism means inside the housing for adjusting the distance between said shafts, the adjustment mechanism means including a screw member, means for coupling the screw member to at least one of the shafts, means for rotating the screw member, and means for electrically sensing the angle of rotation of the screw member;

drive mechanism means for rotating said shafts, said drive mechanism means including means for selecting the rotational direction and angular velocity of said shafts; and a ball feed mechanism which includes a hollow feed body having a side wall and having an outlet which is interposed between said discs, a piston housed in said feed body to reciprocate relative to said outlet, and a ball supply tube coupled to said side wall of the feed body.

2. A pitching machine as claimed in claim 1, wherein said ball feed mechanism further comprises a stopper provided between said outlet and said supply tube.

3. A pitching machine as claimed in claim 2, wherein said stopper comprises a ball member biased into said feed body and retractable therefrom when a ball passes through said feed body.

4. A pitching machine as claimed in claim 1, wherein said feed body is cylindrical and said outlet is tapered, and wherein said ball supply tube is perpendicular to said feed body.

5. A pitching machine as claimed in claim 4, wherein said ball feed mechanism further comprises a rack of teeth mounted to said piston and projecting from said feed body, and motor means for driving said rack to reciprocate said piston.

6. A pitching machine as claimed in claim 1, wherein the means for electrically sensing includes a photo-sensor disc attached to the screw member.

7. A pitching machine as claimed in claim 1, wherein the adjustment mechanism means further comprises another screw member, the screw member and the another screw member being disposed substantially parallel to one another at spaced-apart positions, means for coupling the another screw member to at least one of the shafts, and means for rotating the another screw member in unison with the rotation of the screw member.

8. A machine for throwing balls, comprising:

a housing;

a first disc rotatably mounted on the housing, the first disc having a resilient periphery;

a second disc having a resilient periphery;

mounting means for rotatably mounting the second disc adjacent the first disc so that the peripheries are separated by a gap, the mounting means including a shaft to which the second disc is secured and bearing means for rotatably mounting the shaft on the housing;

adjusting means for moving the second disc, along a line substantially perpendicular to the axis of the second disc, to adjust the width of the gap, the adjusting means including an elongated screw member having an axis which is substantially perpendicular to the axis of the shaft, means for connecting the screw member to the bearing means, a nut member which is screwed onto the screw member, means for rotating one of the screw member and the nut member, and means for electrically sensing the angle of rotation of said one of the screw member and the nut member, the means for electrically sensing including a photo-sensor disc;

driving means for rotating the discs; and feeding means for feeding balls to said gap.

9. The machine of claim 8, wherein the feeding means comprises an element, and means for reciprocating the element, the feeding means feeding one ball to the gap for each reciprocation of the element.

10. The machine of claim 9, wherein the element comprises a piston, and wherein the feeding means further comprises a tubular feed body having an outlet with generally u-shaped tapers, the outlet being disposed adjacent the gap and the piston being disposed in the feed body, and means for introducing balls into the feed body between the piston and the outlet.

11. The machine of claim 10, wherein the feeding means further comprises a stop element, means for mounting the stop element adjacent the outlet of the feed body so that the stop element is movable between a withdrawn position and an extended position wherein a portion of the stop element extends into the feed body, and a spring which biases the stop element toward its extended position.

12. The machine of claim 9, wherein the element comprises a slider, wherein the feeding means further comprises a ball storage chamber having a ball outlet, and a tube assembly having a ball inlet which is spaced apart both horizontally and vertically from the ball outlet, and wherein the slider is disposed between the storage chamber and the tube assembly and transfers balls from the outlet to the inlet as it reciprocates.

13. The machine of claim 12, wherein the slider has an opening which accommodates one ball, the opening being moved between a position below the outlet and a position above the inlet as the slider reciprocates, and wherein the slider further comprises a plate which is disposed below the ball outlet to keep balls from falling out when the opening is positioned over the inlet.

14. The machine of claim 13, wherein the feeding means further comprises means from pneumatically conveying balls from the tube assembly to the gap.

15. The machine of claim 14, wherein the means for coupling comprises a sprocket wheel mounted on the screw member, another sprocket wheel mounted on the another screw member, a further sprocket wheel mounted on the motor, and a chain extending around the sprocket wheels.

16. The machine of claim 8, wherein the driving means comprises means for rotating the discs at different angular velocities.

17. The machine of claim 8, wherein the resilient peripheries of the discs comprise urethane.

18. The machine of claim 8, wherein the mounting means further comprises another bearing means for rotatably mounting the shaft on the housing, and wherein the adjusting means further comprises another elongated screw member having an axis which is substantially perpendicular to the axis of the shaft, means for connecting the another screw member to the bearing means, another nut member which is screwed onto the another screw member, means for rotating one of the another screw member and the another nut member, and means for electrically sensing the angle of rotation of said one of the another screw member and the another nut member, the means for electrically sensing the angle of rotation of said one of the another screw member and the another nut member including another photo-sensor disc.

19. The machine of claim 18, wherein the screw member and the another screw member are disposed substantially parallel to one another at spaced-apart positions.

20. The machine of claim 18, wherein both means for rotating, together, comprise a motor and means for coupling the motor to the screw member and the another screw member.

* * * * *